United States Patent [19]

McClane

[11] 4,248,914

[45] * Feb. 3, 1981

[54] METHOD OF UTILIZING A FLEXIBLE PAINT SHIELD

[75] Inventor: Robert A. McClane, Anaheim, Calif.

[73] Assignee: Impact Manufacturing Co., Inc., Santa Fe Springs, Calif.

[ * ] Notice: The portion of the term of this patent subsequent to Aug. 1, 1992, has been disclaimed.

[21] Appl. No.: 957,034

[22] Filed: Nov. 2, 1978

Related U.S. Application Data

[62] Division of Ser. No. 796,925, May 16, 1977.

[51] Int. Cl.[2] ..... B05B 15/04; B05D 1/02

[52] U.S. Cl. ..... 427/282; 118/504

[58] Field of Search ..... 118/504, 301, 505; 427/282, 272

[56] References Cited

U.S. PATENT DOCUMENTS

| | | | |
|---|---|---|---|
| 2,672,122 | 3/1954 | Kupec et al. | 118/504 |
| 4,085,703 | 4/1978 | Glowacki | 118/504 |

*Primary Examiner*—Morris Kaplan

*Attorney, Agent, or Firm*—Knobbe, Martens

[57] ABSTRACT

Utilizing a spray painting shield comprising a large, flat flexible masking blade attached to an elongated handle. Placing the front edge of the shield along a corner edge formed by a surface to be painted and an adjacent surface. Pushing said handle to flex said blade to about 40°-80° with respect to said edge and adjacent surface.

5 Claims, 3 Drawing Figures

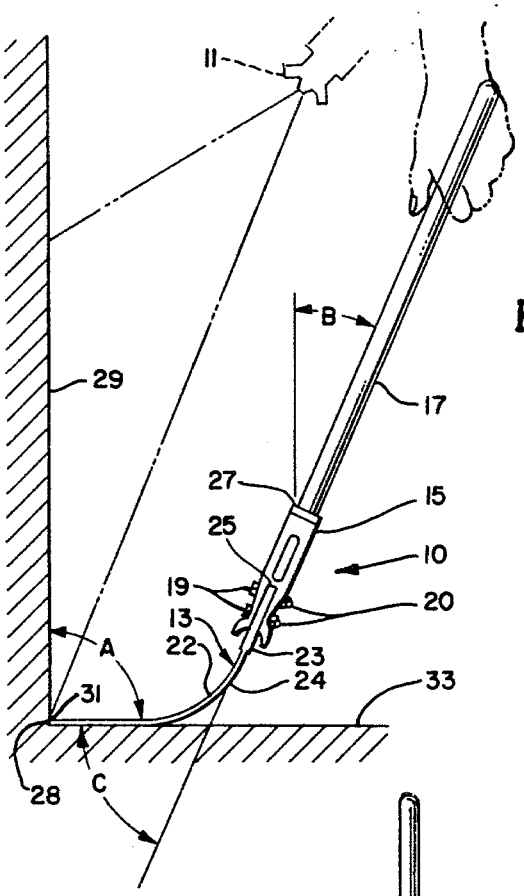
FIG. 1.
FIG. 2.
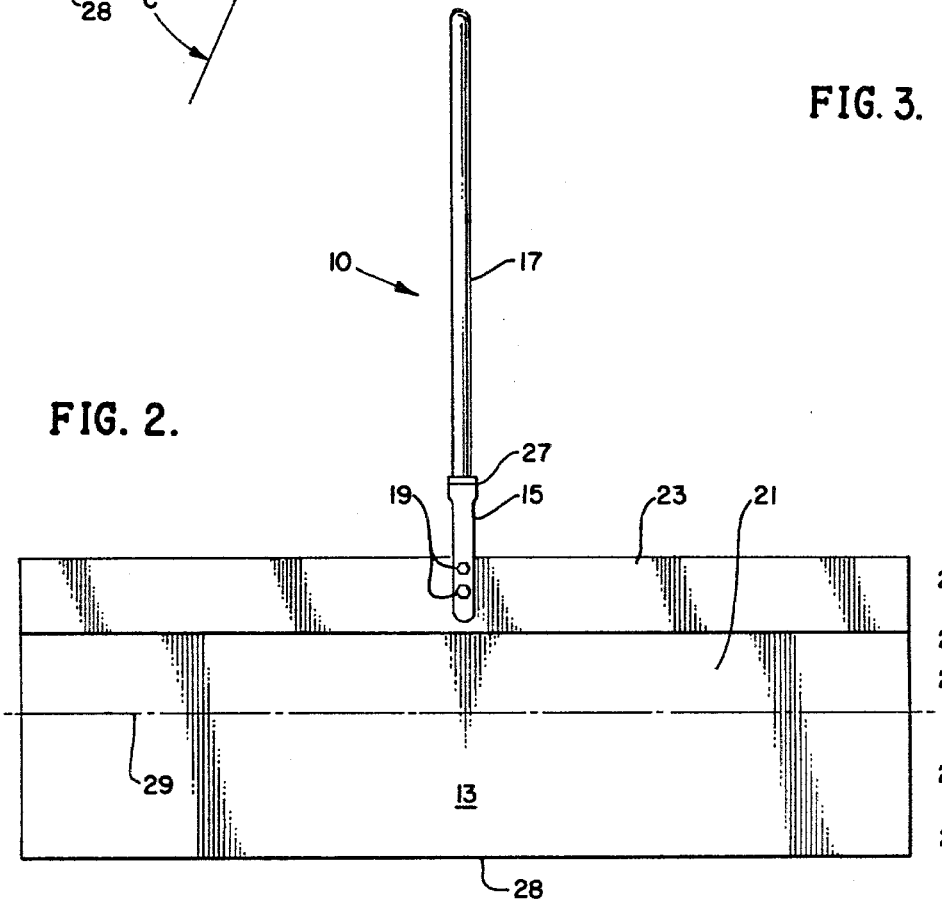
FIG. 3.
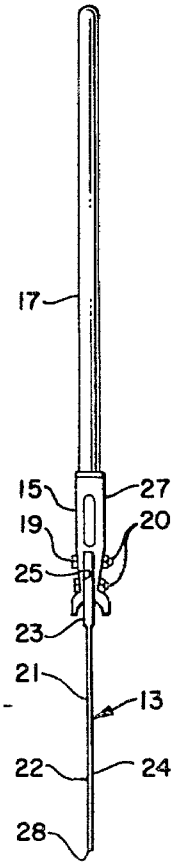

METHOD OF UTILIZING A FLEXIBLE PAINT SHIELD

This is a division of application Ser. No. 796,925, filed May 16, 1977.

BACKGROUND OF THE INVENTION

This invention relates to utilizing spray painting masks and more specifically to positioning portable paint shields at the juncture of walls, ceilings, floors, and other surface areas which must be protected from paint spattering.

In the prior art, many painting shields have been developed for use with paint rollers or brushes. Since these devices cannot be easily adapted for use with spray gun equipment, professional painters have resorted to using large pieces of flat cardboard held against the surface areas to be masked. This technique for masking has been found to be cumbersome and unsatisfactory especially when the cardboard becomes deformed and must be replaced. The usefulness of these temporary masking devices is limited and after their repeated use replacements must be provided. Furthermore, such cardboard pieces are inherently stiff and awkward to hold at a proper angle to the wall, the floor or the ceiling.

Aluminium shields also have been used, but suffer the same disadvantages, and also are easily permanently bent along the edge, destroying their effectiveness.

SUMMARY OF THE INVENTION

The present invention alleviates these and other problems associated with the prior art by providing a long handled paint shield which can be flexed into a corner position to increase its accessibility, has an indestructible leading straight edge, and can be easily cleaned after each use.

The preferred embodiment of the invention described herein comprises utilizing a flat, rectangular, lightweight masking blade having an elongate handle secured to its upper reinforced edge by means of screws and easily detachable nuts. The masking blade is made of material with high flexibility and resiliency permitting substantial flexing along its longitudinal axis. Thus the handle of said shield can be held in a comfortable upright position as pressure is applied to flex the masking blade into a flat position against the corner of the wall being masked.

These and other advantages of the present invention are best understood through a reference of the drawings, in which:

FIG. 1 is an end elevation view of the flexible paint shield of the present invention, showing its use at the juncture corner of a wall and floor;

FIG. 2 is a plan view of the flexible paint shield; and

FIG. 3 is a right side elevation view of the flexible paint shield.

DETAILED DECRIPTION OF THE PREFERRED EMBODIMENT

Referring initially to FIGS. 1 and 2, a paint spray shield 10 is shown used in conjunction with an airless paint spraying gun 11. The paint shield 10 comprises a large rectangular masking blade 13, a connector 15, an elongate handle 17, and fastener bolts and nut 19 and 20. The rectangular blade 13, typically measuring 36 inches by 12 inches, but also provided in various other sizes, is composed of a high impact styrene plastic sheet having a highly flexible forward blade portion 21 with a front face 22 and a back face 24, and a reinforced back edge 23 as best shown in FIG. 3. The reinforced edge 23 of blade 13 fits snugly into a slot 25 in the connector 15 wherein a wood or aluminum handle 17 is attached. The connector 15 is attached at the midpoint of the blade 13 by means of screws 19 and nuts 20. The handle 17 has threads formed at one end whereby it can be twisted tight into the connector 15 having a corresponding threaded aperture (not shown) in the end 27 opposite the slot 25. The screws 19 pass through aperatures in the connector 15 and aligned apertures in the blade 13 thereby locking the handle 17 in a vertical position to the blade 13. The handle 17 is of sufficient length to permit the painter to hold the paint shield 10 with one hand and manipulate the spray gun 11 with the other hand. The handle can be interchanged with one of a different length more suitable to the individual painter's reach, or for working on high ceilings since the handle is connected to the connector 15 by a standard acme thread.

The flexible paint shield 10 is utilized in the following manner. As the vertical surface of a wall 29 (see FIG. 1) is spray painted down to the corner 31, the shield 10 is held in place with its lead edge 28 in the corner 31 and flexed towards position on the floor as shown, by applying a downward pressure to the handle 17. Since the masking blade 13 is made of highly pliable plastic sheet, it extends perpendicularly, or nearly perpendicularly, from the wall 29 along the floor 33 and enables the handle 17 to be held in an angular position most comfortable to the painter, and yet out of the way of the spray from the gun 11. When the pressure is removed the blade 13 will assume its normal flat configuration, unlike aluminum or cardboard which would be permanently damaged, and thus made useless as a workable tool.

The reinforced edge 23 which is approximately three times as thick as the forward blade portion 21 maintains the blade 13 in a normally straight longitudinal position during its use. The handle 17 can be unscrewed to facilitate its replacement or the storage of the paint shield 10 when not used.

Of course, the shield is equally advantageous at vertical corners where one wall or woodwork needs to be shielded, or at the junction between the wall and ceiling.

Another advantage of the pliable masking blade is its ability to be flexed during the cleaning operation. The dried paint build-up after continuous use can be readily flaked off from the glossy surface of the forward portion 21 of the blade 13 by bending or flexing it by hand.

While the amount of flexibility required can be varied, it is essential that the shield have enough flexibility to get the painter's hand out of the way an achieve and angle A between the surface being painted and the shield of as near to 90° as practical and certainly in excess of 60°. Accordingly, it is desirable that a shield of about 12 inches in height be capable of flexing through an angle C of about 40° to 80° under relatively light manual pressure applied along the handle. That permits the handle to be held at an angle B of about 10°–20° to the vertical while maintaining angle A at 60° to 90° ($A=B+C$). At the same time the shield material must be resilient and springy so that the lead edge 20 will press tightly down against the floor, as shown in FIG. 1, when relatively light manual pressure is applied along the handle, rather than having to be applied directly downward in a vertical direction. A limp sheet would not achieve this. The resilience also assures maintaining a good straight edge 28. The stiffened upper edge portion 23 provides strength to permit the desired flex with the desired springiness, assures that flexure is limited to parallel to the longitudinal axis 29, and assures a return to a straight edge 28 when pressure is released.

Another advantage is that because the lead edge 28 is extremely flexible, it is very effective in shielding irregular surfaces such, for example, as created opposite studs where studs are placed apporximately 16" apart, whereas the shield is 36" wide. The stud joints which cannot be readily seen by the naked eye project outward enough to make shielding with an inflexible straight edge very difficult. However, the plastic composition of the blade conforms to irregular surfaces without damage to the tool itself nor allowing overspray under the flexible blade to damage the surface being shielded from the spray.

High impact styrene plastic sheet has been found suitable in a thickness of about 0.060. High density polyethylene, high density polypropylene and ABS also would be suitable.

Those materials also have very desirable characteristics of maintaining a good lead edge 28 after considerable abuse, and for permitting easy removal of dried paint. Due to the high impact and resilient characteristic of the plastic composition of the blade, the leading edge virtually cannot be permanently deformed, which deformation would ruin its effectiveness.

What is claimed is:

1. A method for spray painting one surface and effieciently shielding an adjacent surface using a large flexible masking blade and gripping means on said blade comprising:

using a gripping means comprising an elongate handle;

placing the front edge of said blade along a corner edge formed between said surface to be painted and said adjacent surface;

pushing said gripping means to form a bend in said masking until said masking blade flexes to an angle of about 40° to 80° without permanent deformation of said blade;

spray painting said surface to be painted using a spray gun, said gun being held a convenient distance from said blade thereby causing a paint dispersion with overspray of paint, one end of said gripping means being of sufficient distance from the front edge of said blade length, that upon flexing of the blade, a user's hand holding said gripping means is not reached by said overspray; and providing said masking blade to be of sufficient large height and width that even though said spray paint gun is held at a convenient spraying distance from said blade, said adjacent surface is shielded from said overspray such that said blade does not allow said overspray to reach under said blade to damage said adjacent surface being shielded from said overspray.

2. The method of claim 1 wherein said blade has a reinforced back edge permitting flexing along the longitudinal axis only.

3. The method of claim 2 wherein said reinforced back edge has a sufficiently small width relative to the total width of said blade that although said back edge is stiffer than said blade, said blade easily flexes to an angle of about 40° to80°.

4. The method for shielding defined in claim 1 wherein said masking member is high impact styrene.

5. The method for shielding defined in claim 1 wherein said blade portion is about 0.06 inch thick.

* * * * *